United States Patent [19]

Vishwanath et al.

[11] Patent Number: 4,752,209

[45] Date of Patent: Jun. 21, 1988

[54] PULSE COMBUSTION BURNER FEED VALVE

[75] Inventors: Palamadi S. Vishwanath, Brunswick; James C. Griffiths, Lyndhurst, both of Ohio

[73] Assignee: American Gas Association, Cleveland, Ohio

[21] Appl. No.: 6,500

[22] Filed: Jan. 23, 1987

[51] Int. Cl.[4] ..... F23C 11/04

[52] U.S. Cl. ..... 431/1; 431/189; 60/39.76

[58] Field of Search ..... 431/1, 158; 126/110 R; 60/39.77, 39.81; 122/24

[56] References Cited

U.S. PATENT DOCUMENTS

| | | | |
|---|---|---|---|
| 4,336,791 | 6/1982 | Kitchen | 431/1 |
| 4,640,674 | 2/1987 | Kitchen | 60/39.76 |

FOREIGN PATENT DOCUMENTS

| | | | |
|---|---|---|---|
| 93208 | 5/1985 | Japan | 431/1 |
| 159505 | 8/1985 | Japan | 431/1 |

*Primary Examiner*—James C. Yeung

*Attorney, Agent, or Firm*—Pearne, Gordon, McCoy & Granger

[57] ABSTRACT

A feed valve is disclosed for self-feeding of air or fuel gas to a pulse combustion burner in response to oscillating burner pressures. The feed valve includes a housing having a plurality of flapper valves arranged to provide additive one-way flows into the valve housing and a combined single input flow into the burner.

15 Claims, 5 Drawing Sheets

PULSE COMBUSTION BURNER FEED VALVE

BACKGROUND OF THE INVENTION AND PRIOR ART

The present invention relates to pulse combustion burners and, more particularly, to a high flow capacity feed valve for use in self-feeding one or more components of a combustible gaseous mixture into the burner.

In pulse combustion burners of the Helmholtz type, an oscillating or pulsed flow of combustion gases through the burner is maintained at a frequency determined by burner geometry and fuel supply characteristics, including the mixing of the fuel components. Typically, a combustion chamber of a given size cooperates with a tailpipe or exhaust pipe of specific dimensions to provide explosive combustion cycles, thermal expansion of the gaseous products of combustion, and oscillating gas pressures which provide the pulsed flow of combustion products through the burner. In order to make the pulse combustion process self-substaining, the oscillating gas pressure may be used to provide self-feeding of components of a combustible gaseous mixture which generally comprises air and a gaseous fuel such as natural gas.

It is known to use one-way flapper valves to self-feed air and/or fuel gas to a pulse burner. Such flapper valves include a flexible flapper or diaphragm movably mounted between a valve plate having valve flow openings therein and a backer plate arranged to limit the movement or stroke of the flapper. The flapper is arranged to move between a closed position overlying the valve openings and an opened position adjacent the backer plate in response to the fluid pressures on opposite sides of the flapper. In pulse burner applications, the valve openings and flapper are sized to assure movement in response to the oscillating operating pressures and adequate flow through the valve.

The use of flapper valves has not been entirely satisfactory since they are relatively large valves and tend to interfere with burner applications requiring placement of the burner apparatus in a particular mounting location or an enclosed cabinet. Generally, the air flapper valve will be larger and more troublesome since the ratio of air to natural gas is about 12:1 in most combustion processes.

In higher fuel input burner applications, for example, in the range of 100,000 BTU/hr. or more, the increased size of the flapper valve also makes it more difficult to operate with the prevailing burner pressures and desired frequencies which may range from 10 hertz to several hundred hertz. More particularly, as the flapper valve flow openings increase in size and number, it becomes increasingly more difficult to start and stop the flapper movement as it is biased between its opened and closed position using the oscillating burner pressures. For these reasons, the valve plate is typically provided with one or more circular arrays of valve openings which are engaged by annular shaped flappers retained in aligned position by the backer plate. The flow capacity of the valve is determined by the lesser of the total area of the valve openings or, in adjustable valves, the flow area of the circumferential band or opening between the valve plate and the flapper in its opened position. The flow capacity of the latter valve may be varied by adjustment of the flapper stroke.

The adjustment of the input rate to the burner is more difficult for larger sized flapper valves since small changes in the distance between the valve plate and opened flapper as determined by the spacing of the backer plate result in substantial flow variations. In such cases, the backer plate is adjustably mounted to the valve plate in order to enable variation of the flapper movement or stroke. Accordingly, as the overall diameter of the plates is increased for larger input applications, a given change in plate spacing results in a greater change in flow.

Burner applications in the range of a 1,000,000 BTU/hr. input and more present extreme flapper valve strength requirements. The valve and backer plates must be reinforced by intergral web-type arrangements to resist flexing and stress failure due to exposure to the cyclic pulse burner pressure loads. The cost of the flapper valve is significantly increased by the additional reinforcement required in such applications.

SUMMARY OF THE INVENTION

The present invention provides an improved feed valve especially adapted for high flow capacities in the self-feeding of a combustible mixture of gases to a pulse combustion burner. The feed valve includes an inlet port adapted to be connected to a supply of gas and an outlet port adapted to communicate with the combustion chamber of the pulse burner. The inlet port includes a plurality of flapper valves arranged to provide additive one-way flows of gas into the combustion chamber of the burner in response to the oscillating pressures therein.

The feed valve combines multiple fluid flows through disjuncted flapper valves to effectively provide a single input flow to the burner. The flow directions through the flapper valves do not need to be coaxial, or even parallel, with each other nor with the flow through the outlet port of the flapper valve.

In accordance with the illustrated embodiments, the feed valve includes a chamber defined by housing walls having a plurality of flapper valves mounted therethrough. The flows through the flapper valves are additive and do not interfere with each other. Thus, the flow capacity of a feed valve having multiple flapper valves is proportional to the total flow areas of the flapper valves and substantially equal to the flow capacity of a prior art feed valve having a single flapper valve with the same total flow area.

The placement of flapper valves in opposition to one another enables the provision of a compact feed valve as compared with prior art single flapper valve arrangements of similar flow capacity. Generally, the compactness of a feed valve of a given flow capacity increases with the number of planar walls or faces provided by the overall polyhedron shape of the feed valve. Of course, flapper valves may also be mounted through non-planar walls of the feed valve.

The use of multiple flapper valves also permits the feed valve to be configured in accordance with a desired shape or available mounting space. For example, a narrow mounting space may be utilized by providing the feed valve with a correspondingly elongate housing configuration and a plurality of flapper valves disposed in adjacent and/or opposed relationship along the length thereof.

In accordance with a further advantage of the invention, the burner turndown ratio may be more precisely controlled since the total burner input is divided between a plurality of flapper valves and one or more of the flapper valve flows may be separately varied. In a similar manner, a feed valve having five disjuncted flapper valves mounted in a single housing may be adjusted to provide turndown increments of 20% of the total input capacity by sequentially closing individual flapper valves.

Burner scale-up is also simplified in accordance with the invention since the number of flapper valves may be increased without changing the proportions of individual flapper valve elements. Thus, the particular valve opening dimensions, flapper size, flapper weight, and flapper stroke need not be scaled-up.

For a given size pulse burner, the multiple flapper valves used in accordance with the present invention are each of smaller dimension and flow capacity than the single flapper valve previously required. This size reduction in the flapper valve itself is desirable, since it tends to provide more reliable response to the oscillating burner pressures. It also reduces the flexure and stress loads applied to individual valves and enables a reduction in the cost of the feed valve.

The reduction in overall feed valve size and improvements in reliability are demonstrated by consideration of a 3,500,000 BTU/hr. burner wherein a 20-inch diameter, single flapper air feed valve was used to provide the required air flow. The valve and backer plates were made of ¼ inch thick steel plate. A total flow area of 10 in.$^2$ was provided by five concentric circular arrays of valve openings in the valve plate. The backer plate included corresponding openings to assure biasing of the five annular shaped flapper valves. This valve failed after about 45 minutes of operation, when the backer plate cracked. This failure is believed due to the flexure of the backing plate. In contrast, a feed valve according to the invention was provided for this burner in a cube-shaped housing, 7 inches on a side, having one 5-inch diameter flapper valve mounted in each of five planar faces of the housing. The valve and backer plates of this feed valve were also formed of ¼ inch thick steel plate and each flapper valve provided 1/5 of the required air flow. This feed valve provided continuous burner operation without failure throughout extended test periods. The burner is more compact and more readily incorporated into a wide range of burner designs. The cube-shaped feed valve is also less expensive to manufacture as compared with the single flapper air feed valve of the prior art.

DETAILED DESCRIPTION OF THE DRAWINGS

Figure 1:
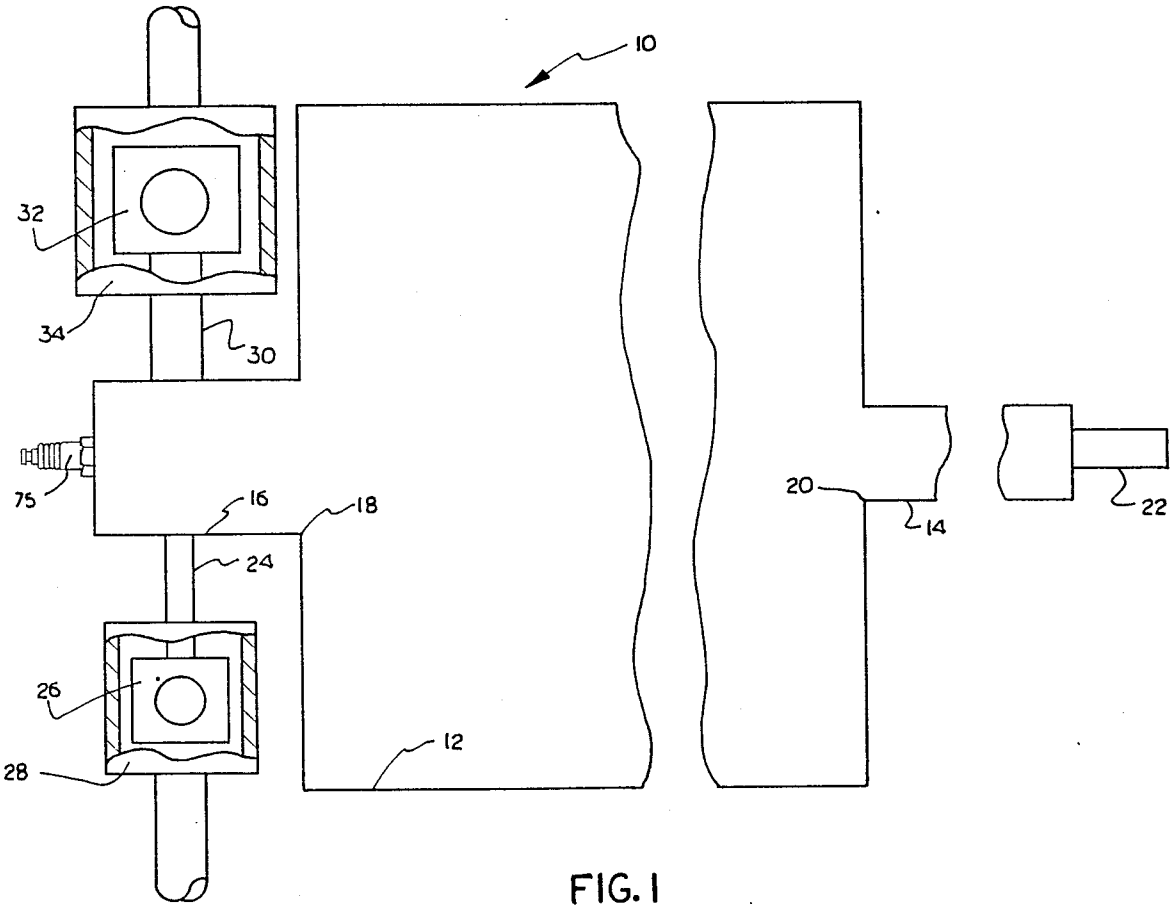
FIG. 1 is a diagrammatic, elevational view of a pulse combustion burner having air and fuel gas feed valves in accordance with the invention.

Referring to FIG. 1, there is shown a pulse combustion burner 10 having a combustion chamber 12 and a a tailpipe or exhaust pipe 14. A mixer head 16 is arranged to deliver a combustible mixture of gases to an inlet 18 of the combustion chamber 12. The products of combustion flow through an outlet 20 of the combustion chamber 12 and into the tailpipe 14 for discharge to the atmosphere through a vent pipe 22.

A fuel gas, such as natural gas, is supplied to the mixer head 16 through line or conduit 24. The introduction of gas is regulated by a fuel gas feed valve 26 which is connected to a supply of fuel gas 28. The fuel gas supply 28 may comprise a fluidtight enclosure which is connected to a plant fuel gas supply line.

Air is supplied to the mixer head 16 through air line or conduit 30. The flow of air is controlled by a feed valve 32 which is connected to a supply of air 34. The air supply 34 may comprise an air box for delivery of pressurized air to the valve 32. Of course, the feed valve 32 may draw air from the atmosphere without the use of additional structure such as air supply 34.

The feed valves 26 and 32 are substantially identical in construction and operation, and therefore only valve 32 is discussed below.

Figure 2:
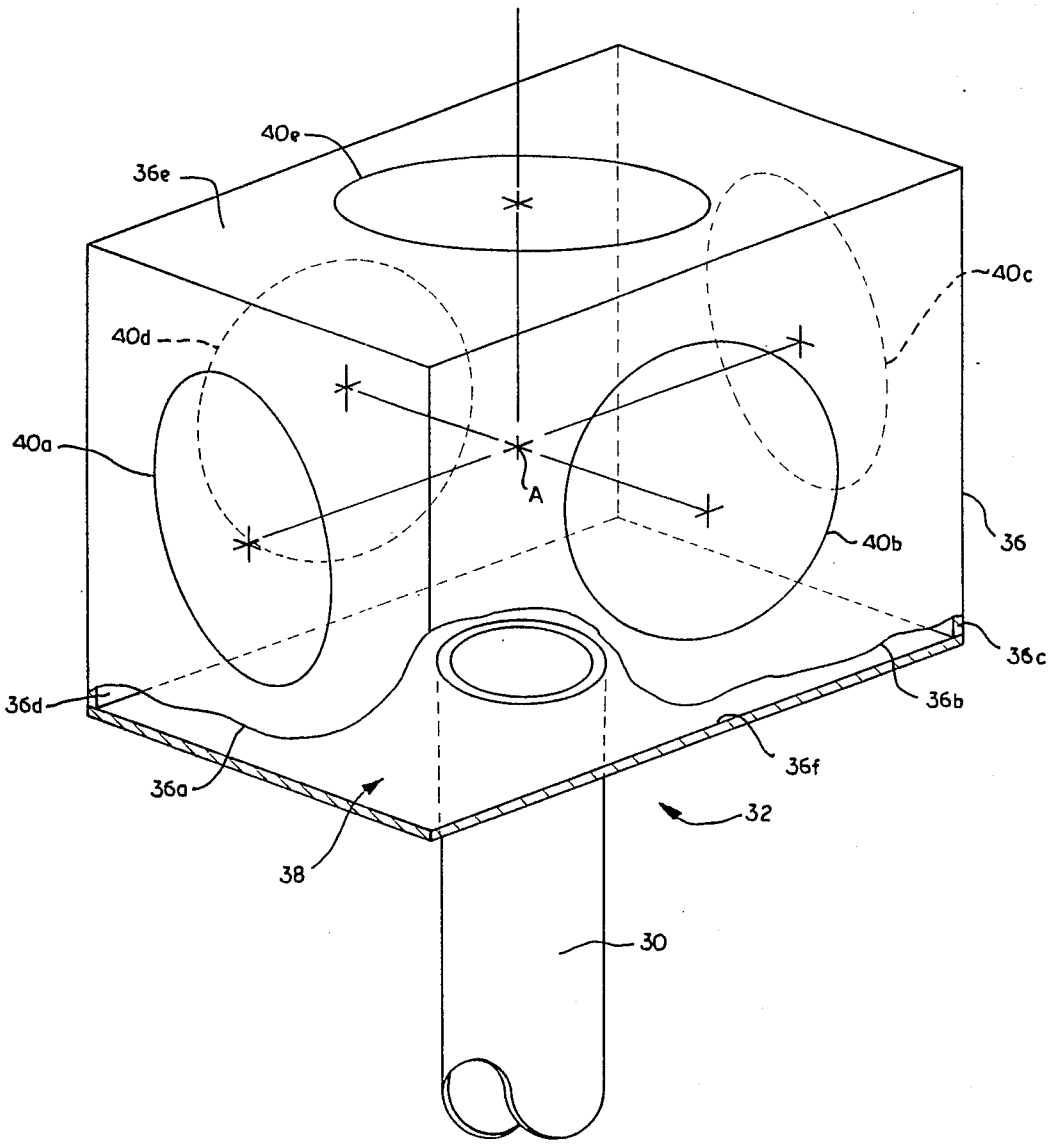
FIG. 2 is a diagrammatic, perspective view on an enlarged scale of the air feed valve shown in FIG. 1, with parts broken away and omitted.

Referring to FIG. 2, the feed valve 32 includes a housing 36 having a cubic configuration. The housing 36 includes four side walls **36*a* to 36*d*, a top wall 36*e*, and a lower wall 36*f*. The walls 36*a* to 36*f* are formed of metal, such as steel plate, and are welded together to provide a fluidtight chamber 38 of the feed valve 32**.

Flapper valves **40*a* to 40*e* are respectively mounted through associated walls 36*a* to 36*e* of the housing 36. (For convenience, the flapper valves 40*a* through 40*e* are diagrammaticaly shown in circle outline form in FIG. 2.) The flapper valves 40*a* to 40*e* cooperate to provide an inlet port for the feed valve 32. The air line 30 is connected to the lower wall 36*f* to provide an outlet port for the feed valve 32**.

The valves **40*a* to 40*e* are centrally located in their associated walls, and may have a diameter equal to about 70% of the minimum wall width or length. In the cubic configuration herein, the valve pairs 40*a*, 40*c*, and 40*b*, 40*d* each provide opposite air flows along common flow axes which intersect adjacent a central location indicated at point A within the chamber 38. The flow through the valve 40*e* also passes through the central location at point A. In this embodiment, the central location is equally spaced from flapper valves 40*a* to 40*e*, and it is disposed adjacent the valve outlet port when line 30 is connected to wall 36*f*. The intersection of the flows through the valves has not been found detrimental to the operation of the pulse burner. It is believed that the multiple flows combine within the chamber 38 to provide a suitable pulsatile flow to the burner in response to the oscillating pressures therein and that such pulsatile flow is enhanced by the intersection of the flows within the chamber 38**.

Figure 3:
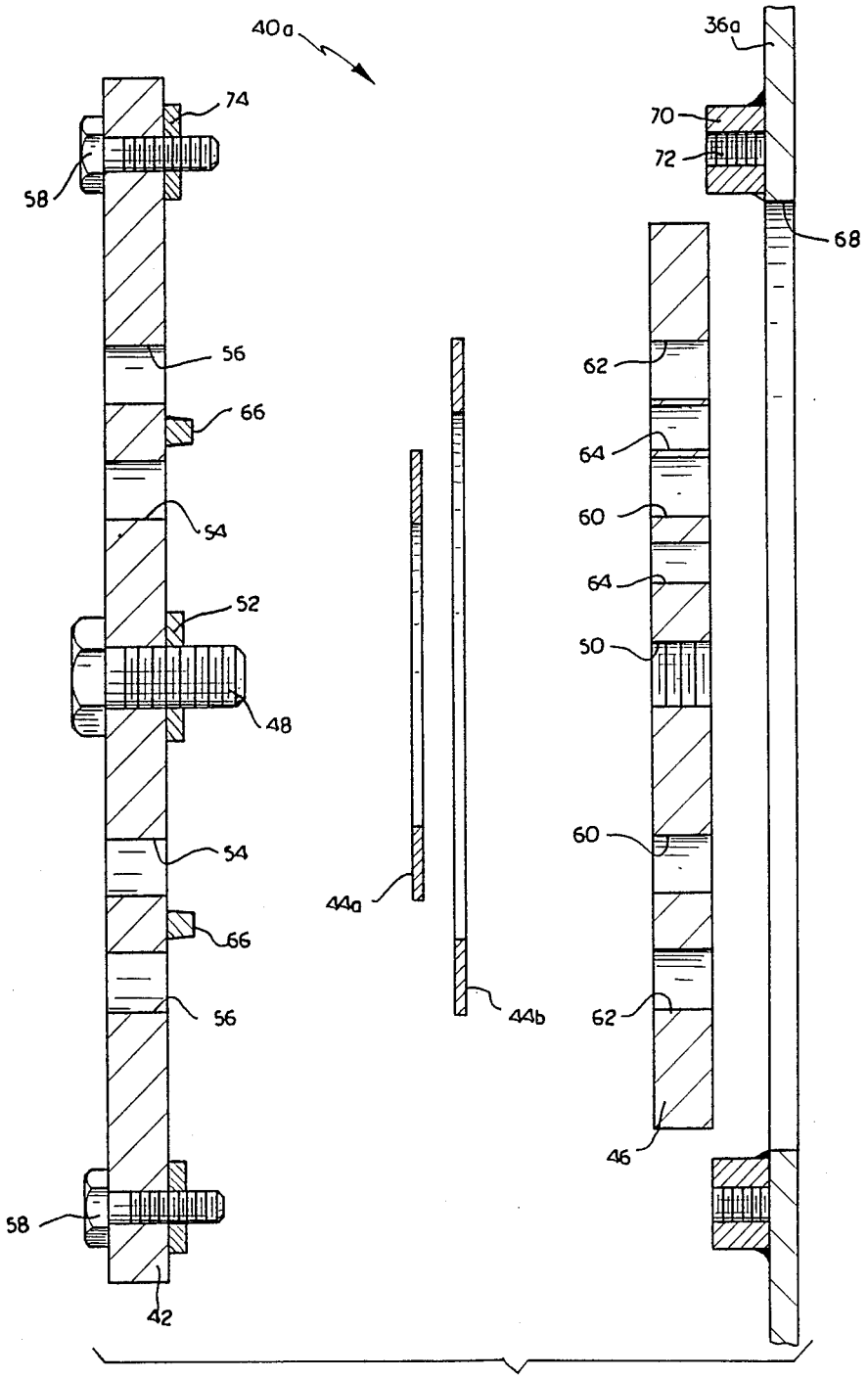
FIG. 3 is an exploded, sectional view on an enlarged scale of a flapper valve portion of the feed valve, with parts broken away.
Figure 4:
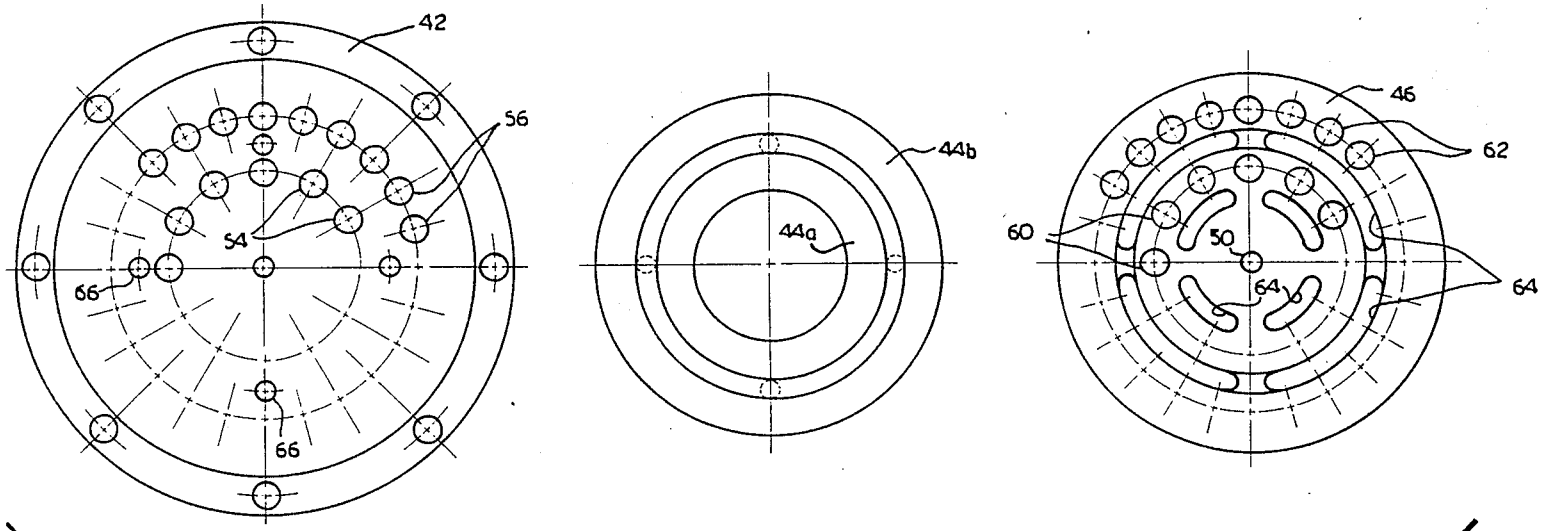
FIG. 4 is a diagrammatic plan view showing the valve plate, flappers, and backer plate of the flapper valve shown in FIG. 3.

Referring to FIGS. 3 and 4, the details of the construction of the flapper valve **40*a* are shown. The flapper valves 40*b* to 40*e* are identical in construction and operation with the valve 40*a***.

The flapper valve 40*a* includes as its major components a valve plate 42, flappers 44*a*, 44*b*, and a backer plate 46. The valve plate 42 and the backer plate 46 are each formed of metal, such as ¼ inch thick steel plate. The backer plate 46 is mounted to the valve plate 42 by a bolt 48 which is received in the threaded opening 50. The flappers 44*a*, 44*b* are entrapped between the plates 42, 46. A spacer 52 is used to adjustably fix the distance between the plates 42 and 46.

The valve plate 42 includes two circular arrays of valve openings 54 and 56. The valve plate also includes an outer circular pattern of mounting bolts 58 for mounting Qthe flapper valve 40*a* to the housing 36.

The flappers 44*a*, 44*b* are flexible members and may be formed of Teflon-coated fiber glass, 0.010 inch thick and weighing 0.355 gram per square inch. The flappers are sized to overlie and close valve openings 54 and 56 when biased to the left against the valve plate 42.

The backer plate 46 includes two circular arrays of backer plate openings 60 and 62 which correspond in size and position with the openings 54 and 56, respectively. The backer plate also includes elongate openings 64 to enhance pressure biasing of the flappers 44*a*, 44*b*. (In FIG. 3, the section of the plate 46 is taken along two different radii to show the elongate openings 64.)

Upon assembly of the plates 42 and 46, the flappers 44*a* and 44*b* are radially aligned by locater pins 66. The assembled flapper valve 40*a* is mounted through an opening 68 in the side wall 36*a*. To that end, a mounting flange 70 extends about the opening 68 and is secured to the wall 36*a* by any convenient means such as welding. The mounting flange 70 includes threaded openings 72 for engagement with the bolts 58. A mounting gasket 74 is provided in order to assure a fluidtight seal.

In a typical application, flow through the flapper valve 40*a* may be restricted by the combined areas of the valve openings 54, 56, or by the spacing between the plates 42, 46. In the latter case, the flow is actually restricted by the area of the circumferentially extending opening between the adjacent surfaces of the valve plate 42 and the flapper 44*b*.

During the operation of the burner, oscillating pressures within the burner are imposed upon the flappers 44*a*, 44*b* via the mixer head 16 and line 30. An increasing burner pressure biases the flappers 44*a*, 44*b* to the left, as shown in FIG. 3, so as to overcome the oppositely biasing forces of the air supply pressure. In the closed position, the flappers 44*a*, 44*b* overlie the valve openings 54, 56 and prevent gas flow from the burner 10 through the valve 32.

As the pressure decreases and becomes negative within the burner 10, the air supply pressure is sufficient to bias the flappers 44*a*, 44*b* toward the backer plate 46. This allows the supply air to flow through the openings 54, 56 into the chamber 38 defined by the valve housing 36 for delivery to the mixing head 16 via line 30. The flow of fuel gas into the mixer head 16 is similarly controlled by the valve 26.

The air and fuel gas mix flows into the mixer head 16 to provide a combustible mixture of gases wihch self-ignities during steady-state operating or is ignited by sparkplug 75 during burner start-up. The explosive combustion cycle continues as the gases pass into the combustion chamber 12. Continued operation results in cyclic periods of positive and negative pressure within the burner 10 and the pulsatile flow of the products of combustion. The feed valves 26 and 32 provide continued self-feeding of air and fuel gas in response to the burner pressures and the combustion process is self-sustaining.

It is not necessary for both air and fuel gas to be supplied with a feed valve including multiple flapper valves. In many cases, the air flow only will be supplied using such a feed valve and the fuel gas may be supplied in any suitable manner. Further, the feed valves may supply air or fuel directly to a combustion chamber of a main burner which does not have a separate mixer head as disclosed in application Ser. No. 916,405, filed Oct. 21, 1986, which application is also owned by the assignee of the present invention.

Figure 5:
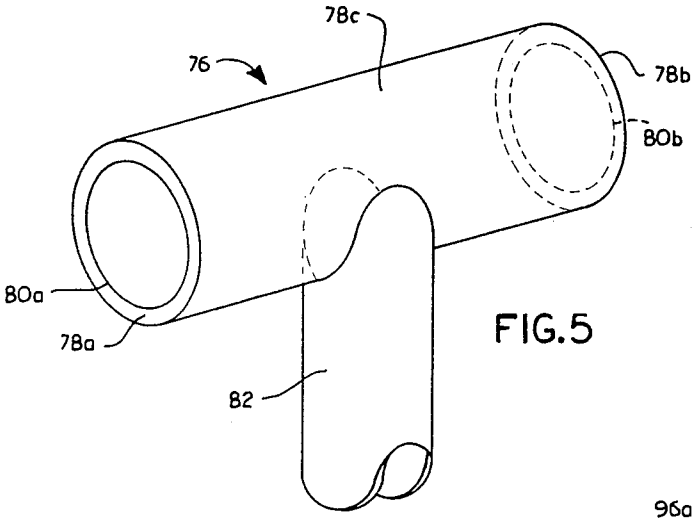
FIG. 5 is a diagrammatic, perspective view showing another embodiment of a feed valve in accordance with the invention.

Referring to FIG. 5, a feed valve 76 having a generally cylindrical configuration is shown. The feed valve 76 includes planar end walls 78*a* and 78*b* having associated flapper valves 80*a* and 80*b*. A cylindrical wall 78c extends between the end walls 78*a* and 78*b* to define a valve chamber which communicates with the burner via line 82. In this embodiment, opposed flows through the flapper valves 80*a* and 80*b* intersect adjacent line 82 for delivery to the burner.

Figure 6:
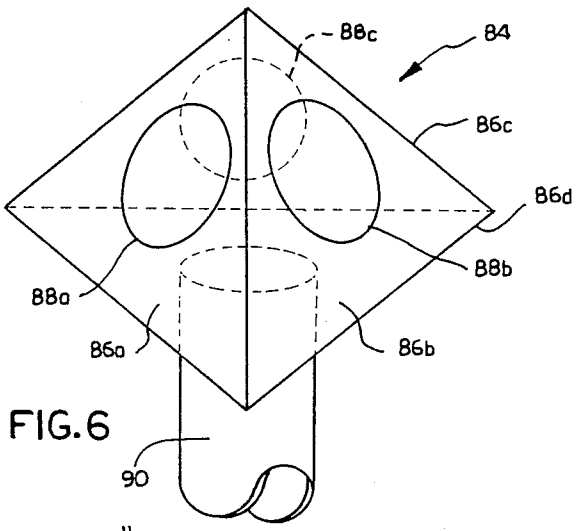
FIG. 6 is similar to FIG. 5, and shows another embodiment of a feed valve.

Referring to FIG. 6, a feed valve 84 having a pyramidal configuration is shown. In this instance, the feed valve includes planar side walls 86*a* to 86*c* and associated flapper valves 88*a* to 88*c*. The output of the valve is delivered through line 90 which is connected to a bottom wall 86*d*.

Figure 7:
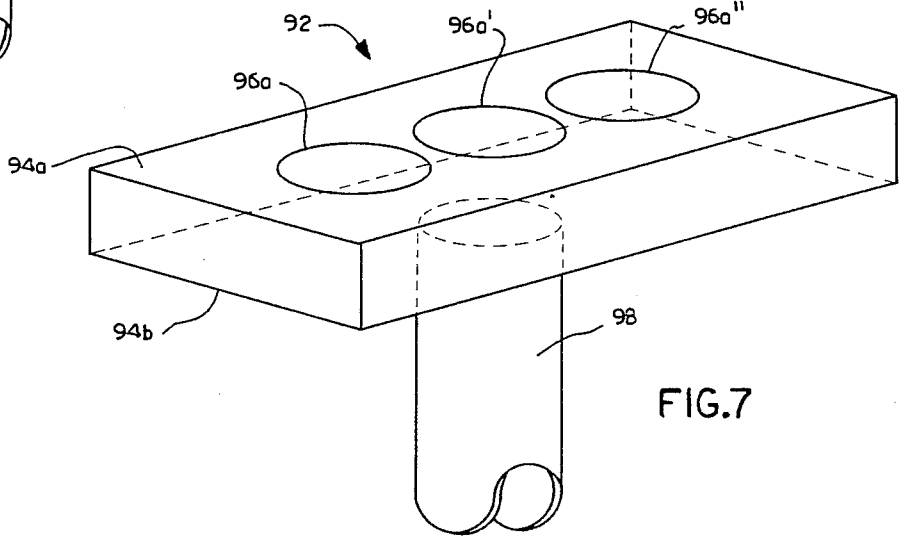
FIG. 7 is similar to FIG. 6 and shows yet another embodiment of a feed valve in accordance with the invention.

Referring to FIG. 7, a feed valve 92 having an elongate, rectangular configuration is shown. (As used herein, the term "rectangular" is used in a broad sense and includes within its meaning the term "square.") The feed valve 92 includes major walls 94*a* and 96*b* which are connected by four side walls to provide a valve chamber. Flapper valves 96*a*, 96*a*′ and 96*a*″ are mounted in wall 94*a* and provide parallel flows into the valve 92. The output of the valve 92 is delivered through a line 98 connected to wall 94*b*.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A pulse combustion burner comprising combustion chamber means having an inlet and an outlet, exhaust means connected to said combustion chamber means outlet, and means for supplying a combustible mixture of gases to said combustion chamber means inlet, said combustion chamber means and exhaust means cooperating to provide pulse combustion of said combustible mixture of gases and products of combustion which have an oscillating pressure for self-feeding at least one of said gases of said combustible mixture of gases, said means for supplying said combustible mixture of gases including feed valve means for controlling the feeding of said one gas, said feed valve means including valve housing means having opposed wall means and inlet and outlet port means, said inlet port means being adapted to be connected to a supply of said one gas and said outlet port means being in fluid communication with said combustion chamber means, said inlet port means including a separate flapper valve extending through each of said opposed wall means to provide additive one-way flows of said one gas into said valve housing means and combustion chamber means in response to said oscillating pressure.

2. A burner according to claim 1, wherein said opposed wall means include at least two opposed wall portions and each of said flapper valves extends through a major portion of the area of its associated wall portion.

3. A burner according to claim 2, wherein said one-way flows of said one gas intersect adjacent a central location within said housing means.

4. A burner according to claim 3, wherein said central location is substantially equally spaced from each of said flapper valves and disposed adjacent said outlet port means.

5. A burner according to claim 2, wherein said housing means is a fluidtight housing having metal walls providing said opposed wall portions, each of said flapper valves comprises a valve plate having a plurality of valve openings therethrough and mounted to an associated one of said walls, a flapper member arranged to move in response to said oscillating burner pressure between a closed position overlying said valve openings and an opened position spaced from said valve openings, and a backer plate connected to said valve plate and arranged to entrap said flapper between said plates.

6. A burner according to claim 1, wherein said valve housing means has a polyhedron configuration including a plurality of planar faces providing said opposed wall means, and at least two of said planar faces have an associated flapper valve extending therethrough.

7. A burner according to claim 1, including a second feed valve for controlling the feeding of a second one of said gases to said burner.

8. In a pulse combustion burner including combustion chamber means and exhaust means, wherein explosive combustion cycles of a combustible mixture of gases provide products of combustion which have an oscillating pressure for self-feeding at least one of said gases of said mixture of gases, the improvement comprising a feed valve means for controlling the feeding of said one gas, said feed valve means including valve housing means having opposed wall means and inlet and outlet port means, said inlet port means being adapted to be connected to a supply of said one gas and said outlet port means being adapted to communicate with said combustion chamber, said inlet port means including a separate flapper valve extending through each of said opposed wall means to provide additive one-way flows of said one gas into said valve housing means and combustion chamber means in response to said oscillating pressure.

9. A burner according to claim 8, wherein each of said flapper valves comprises a valve plate and a backer plate having a flexible flapper diposed therebetween for valve closing movement toward said valve plate and opening movement toward said backer plate and each of said flapper valve extends through a major portion of the area of its associated wall means.

10. A burner according to claim 9, wherein said valve housing means comprises a fluidtight housing and said opposed wall means comprise opposed wall portions having said flapper valves mounted therethrough.

11. A burner according to claim 10, wherein said housing includes at least three opposed wall portions and an associated one of said flapper valves is mounted in each of said wall portions for providing opposed gas flows into said housing.

12. A burner according to claim 11, wherein said housing includes a cylinder shaped wall, said opposed wall portions comprise circular-shaped end walls, and said cylinder shaped wall joins said end walls.

13. A burner according to claim 11, wherein said housing has a pyramidal shape and said opposed wall portions comprise triangle-shaped side walls.

14. A burner according to claim 11, wherein said housing has a rectangular shape including six planar walls and said opposed wall portions comprise at least five of said walls.

15. A burner according to claim 11, wherein said outlet port means includes a conduit connected between said housing and burner, said one-way flows of said one gas intersect adjacent a central location within said housing adjacent said conduit connection.

* * * * *